United States Patent [19]

Lewis et al.

[11] Patent Number: 5,062,364

[45] Date of Patent: Nov. 5, 1991

[54] PLASMA-JET IMAGING METHOD

[75] Inventors: Thomas E. Lewis, E. Hampstead; Richard A. Williams, Hampstead; John P. Gardiner, Londonderry; John F. Kline, Hudson, all of N.H.

[73] Assignee: Presstek, Inc., Hudson, N.H.

[21] Appl. No.: 554,089

[22] Filed: Jul. 17, 1990

Related U.S. Application Data

[63] Continuation of Ser. No. 329,979, Mar. 29, 1989, Published Application No.

[51] Int. Cl.[5] ..... B41C 1/05; B41C 1/10

[52] U.S. Cl. ..... 101/467; 346/159

[58] Field of Search ..... 101/467; 346/159

[56] References Cited

U.S. PATENT DOCUMENTS 3,978,492 8/1976 Simm ..... 346/159

4,082,902 4/1978 Suzuki et al. ..... 101/467 X 4,718,340 1/1988 Love, III ..... 101/467 X 4,727,388 2/1988 Sheridon et al. ..... 346/159

FOREIGN PATENT DOCUMENTS 130028 1/1985 European Pat. Off. ..... 101/467

*Primary Examiner*—Clifford D. Crowder

*Attorney, Agent, or Firm*—Cesari and McKenna

[57] ABSTRACT

A method of imaging a lithographic plate having a printing surface comprises exposing the printing surface to plasma jet discharges between the plate and a plasma jet nozzle spaced close to the printing surface of the plate. These plasma jet discharges are sufficient to remove a layer or layers of the plate to thereby change the affinity of the printing surface for ink and/or water at the points thereof exposed to the discharges, thereby producing image spots on the plate.

16 Claims, 4 Drawing Sheets

PLASMA-JET IMAGING METHOD

This application is a continuation of application Ser. No. 329,979 filed Mar. 29, 1989, now abandoned.

This invention relates to offset lithography. It relates more specifically to method and apparatus for imaging lithography plates.

BACKGROUND OF THE INVENTION

There are a variety of known ways to print hard copy in black and white and in color. The traditional techniques include letterpress printing, rotogravure printing and offset printing. These conventional printing processes produce high quality copies. However, when only a limited number cf copies are required, the copies are relatively expensive. In the case of letterpress and gravure printing, the major expense results from the fact that the image has to be cut or etched into the plate using expensive photographic masking and chemical etching techniques. Plates are also required in offset lithography. However, the plates are in the form of mats or films which are relatively inexpensive to make. The image is present on the plate or mat as hydropholic and hydrophobic (and ink-receptive) surface areas. In wet lithography, water and then ink are applied to the surface of the plate. Water tends to adhere to the hydrophilic or water-receptive areas of the plate creating a thin film of water there which does not accept ink. The ink does adhere to the hydrophobic areas of the plate and those inked areas, usually corresponding to the printed areas of the original document, are transferred to a relatively soft blanket cylinder and, from there, to the paper or other recording medium brought into contact with the surface of the blanket cylinder by an impression cylinder.

Most conventional offset plates are also produced photographically. In a typical negative-working, subtractive process, the original document is photographed to produce a photographic negative. The negative is placed on an aluminum plate having a water-receptive oxide surface that is coated with a photopolymer. Upon being exposed to light through the negative, the areas of the coating that received light (corresponding to the dark or printed areas of the original) cure to a durable oleophilic or ink-receptive state. The plate is then subjected to a developing process which removes the noncured areas of the coating that did not receive light (corresponding to the light or background areas of the original). The resultant plate now carries a positive or direct image of the original document.

If a press is to print in more than one color, a separate printing plate corresponding to each color is required, each of which is usually made photographically as aforesaid. In addition to preparing the appropriate plates for the different colors, the plates must be mounted properly on the print cylinders in the press and the angular positions of the cylinders coordinated so that the color components printed by the different cylinders will be in register on the printed copies.

The development of lasers has simplified the production of lithographic plates to some extent. Instead of applying the original image photographically to the photoresist-coated printing plate as above, an original document or picture is scanned line-by-line by an optical scanner which develops strings of picture signals, one for each color. These signals are then used to control a laser plotter that writes on and thus exposes the photoresist coating on the lithographic plate to cure the coating in those areas which receive light. That plate is then developed in the usual way by removing the unexposed areas of the coating to create a direct image on the plate for that color. Thus, it is still necessary to chemically etch each plate in order to create an image on that plate.

There have been some attempts to use more powerful lasers to write images on lithographic plates. However, the use of such lasers for this purpose has not been entirely satisfactory because the photoresist coating on the plate must be compatible with the particular laser which limits the choice of coating materials. Also, the pulsing frequencies of some lasers used for this purpose are so low that the time required to produce a halftone image on the plate is unacceptably long.

There have also been some attempts to use scanning E-beam apparatus to etch away the surface coatings on plates used for printing. However, such machines are very expensive. In addition, they require that the workpiece, i.e. the plate, be maintained in a complete vacuum, making such apparatus impractical for day-to-day use in a printing facility.

An image has also been applied to a lithographic plate by electro-erosion. The type of plate suitable for imaging in this fashion has an oleophilic plastic substrate, e.g. Mylar plastic film, having a thin coating of aluminum metal with an overcoating of conductive graphite which acts as a lubricant and protects the aluminum coating against scratching. A stylus electrode in contact with the graphite surface coating is caused to move across the surface of the plate and is pulsed in accordance with incoming picture signals. The resultant current flow between the electrode and the thin metal coating is by design large enough to erode away the thin metal coating and the overlying conductive graphite surface coating thereby exposing the underlying ink receptive plastic substrate on the areas of the plate corresponding to the printed portions of the original document. This method of making lithographic plates is disadvantaged in that the described electroerosion process only works on plates whose conductive surface coatings are very thin and the stylus electrode which contacts the surface of the plate sometimes scratches the plate. This degrades the image being written onto the plate because the scratches constitute inadvertent or unwanted image areas on the plate which print unwanted marks on the copies.

Finally, we are aware of a press system, only recently developed, which images a lithographic plate while the plate is actually mounted on the print cylinder in the press. The cylindrical surface of the plate,, treated to render it either oleophilic or hydrophilic, is written on by an ink jetter arranged to scan over the surface of the plate. The ink jetter is controlled so as to deposit on the plate surface a thermoplastic image-forming resin or material which has a desired affinity for the printing ink being used to print the copies. For example, the image-forming material may be attractive to the printing ink so that the ink adheres to the plate in the areas thereof where the image-forming material is present and phobic to the "wash" used in the press to prevent inking of the background areas of the image on the plate.

While that prior system may be satisfactory for some applications, it is not always possible to provide thermoplastic image-forming material that is suitable for jetting and also has the desired affinity (philic or phobic) for all of the inks commonly used for making lithographic copies. Also, ink jet printers are generally unable to produce small enough ink dots to allow the production of smooth continuous tones on the printed copies, i.e. the resolution is not high enough.

Thus, although there have been all the aforesaid efforts to improve different aspects of lithographic plate production and offset printing, these efforts have not reached full fruition primarily because of the limited number of different plate constructions available and the limited number of different techniques for practically and economically imaging those known plates. Accordingly, it would be highly desirable if new and different lithographic plates became available which could be imaged by writing apparatus able to respond to incoming digital data so as to apply a positive or negative image directly to the plate in such a way as to avoid the need of subsequent processing of the plate to develop or fix that image.

SUMMARY OF THE INVENTION

Accordingly, the present invention aims to provide an improved method for imaging lithographic printing plates.

Another object of the invention is to provide a method of imaging lithographic plates which can be practiced while the plate is mounted in a press.

Still another object of the invention is to provide a method for writing both positive and negative or background images on lithographic plates.

Still another object of the invention is to provide such a method which can be used to apply images to a variety of different kinds of lithographic plates.

A further object of the invention is to provide a method of producing on lithographic plates half tone images with variable dot sizes.

A further object of the invention is to provide improved apparatus for imaging lithographic plates.

Another object of the invention is to provide apparatus of this type which applies the images to the plates efficiently and with a minimum consumption of power.

Another object of the invention is to provide an imaging apparatus that can generate a photographic master without having to develop the image on the master.

A further object of the invention is to provide an apparatus of this type capable of both indirect writing on certain polymer coated plates and direct writing on silicone-based plates.

Still another object of the invention is to provide such apparatus which lends itself to control by incoming digital data representing an original document or picture.

Other objects will, in part, be obvious and will, in part, appear hereinafter. The invention accordingly comprises an article of manufacture possessing the features and properties exemplified in the constructions described herein and the several steps and the relation of one or more of such steps with respect to the others and the apparatus embodying the features of construction, combination of elements and the arrangement of parts which are adapted to effect such steps, all as exemplified in the following detailed description, and the scope of the invention will be indicated in the claims.

In accordance with the present invention, images are applied to a lithographic printing plate by altering the plate surface characteristics at selected points or areas of the plate using a non-contacting writing head which scans over the surface of the plate and is controlled by incoming picture signals corresponding to the original document or picture being copied. The writing head comprises one or more precisely positioned electrodes or plasma jet sources each of which uses an electric arc between a pair of electrodes to heat a working gas. The working gas is heated by the arc such that it becomes ionized and disassociated to form a conductive plasma. Short duration, high voltage pulses are used to produce the arc so that the plasma jet discharges are of short duration. Each such discharge creates, on the surface of the plate, a precisely controlled and positioned intense heat zone at the point of contact with the plate surface to be imaged.

In response to the incoming picture signals and ancillary data keyed in by the operator such as dot size, screen angle, screen mesh, etc. and merged with the picture signals, high voltage pulses having precisely controlled voltage and current profiles are applied to the plasma jet source electrode or multiple such sources to produce precisely positioned and defined plasma jet or plasma arc discharges to the plate which etch, erode or otherwise transform selected points or areas of the plate surface to render them either receptive or non-receptive to the printing ink that will be applied to the plate to make the printed copies.

Preferably, each plasma jet source operates in a so-called jet transfer mode wherein the arc and plasma jet extend from a nozzle in the source to the workpiece being heated, in this case, the lithographic plate. Plasma arc discharges operate in a like manner in an atmosphere of working gas suitable for conductive arcs.

Lithographic plates are made ink receptive or oleophilic initially by providing them with surface areas consisting of plastic materials to which oil and rubber based inks adhere readily. On the other hand, plates are made ink repellent or oleophobic initially by providing them with low surface energy coatings to which inks cannot adhere. As will be seen later, certain ones of these plate embodiments are suitable for wet printing, others are better suited for dry printing. Also, different ones of these plate constructions are preferred for direct writing; others are preferred for indirect or background writing.

The present apparatus can write images on these different lithographic plates having either ink receptive or ink repellent surfaces. In other words, if the plate surface is repellent initially, our apparatus will write a positive image on the plate by rendering ink receptive or oleophilic the points or areas of the plate surface corresponding to the printed portion of the original document. On the other hand, if the plate surface is ink receptive or oleophilic initially, the apparatus will apply a background or negative image to the plate surface by rendering hydrophilic the points or areas of that surface corresponding to the background or non-printed portion of the original document. Conventional printing with dampening water (solution) then renders these areas ink repellent or oleophobic. Direct or positive writing is usually preferred since the amount of plate surface area that has to be written on or converted is less because most documents have less printed areas than non-printed areas.

The plate imaging apparatus incorporating our invention is preferably implemented as a scanner or plotter whose writing head consists of one or more plasma gas jet sources positioned over the working surface of the lithographic plate and moved relative to the plate so as to collectively scan the plate surface. Each plasma jet source or electrode is energized by an incoming stream of picture signals which is an electronic representation of an original document or picture. The signals can originate from any suitable source such as an optical scanner, a disk or tape reader, a computer, telecommunication apparatus, electronic pre-press system, etc. These signals are formatted so that the apparatus' plasma jet source, electrode or multiple such sources writes a positive or negative image onto the surface of the lithographic plate that corresponds to the original document.

If the lithographic plates being imaged by our apparatus are flat, then the plasma jet source, electrode or multiple such sources may be incorporated into a flat bed scanner or plotter. Usually, however, such plates are designed to be mounted to a print cylinder. Accordingly, for most applications, the source or sources is incorporated as a writing head into a so-called drum scanner or plotter with the lithographic plate being mounted to the cylindrical surface of the drum. Actually, as we shall see, our invention can be practiced on a lithographic plate already mounted in a press to apply an image to that plate in situ. In this application, then, the print cylinder itself constitutes the drum component of the scanner or plotter.

To achieve the requisite relative motion between the writing head and the cylindrical plate, the plate can be rotated about its axis and the head moved parallel to the rotation axis so that the plate is scanned circumferentially with the image on the plate "growing" in the axial direction. Alternatively, the writing head can move parallel to the drum axis and after each pass of the head, the drum can be incremented angularly so that the image on the plate grows circumferentially. In both cases, after a complete scan by the head, an image corresponding to the original document or picture will have been applied to the surface of the printing plate.

As the writing head traverses the plate, it is maintained at a small distance above the plate surface. Air or other gas blends under pressure may be introduced between the assembly and the plate to provide oxygen or other reagents for the etching process and to expel residue from the etching area. That gas flow also provides a cushion for the write head to prevent its contacting, and possibly, scratching the plate surface. In response to the incoming picture signals, which usually represent a half tone or screened image, each plasma jet source or electrode is pulsed or not pulsed at selected points in the scan depending upon whether, according to the incoming data, that source is to write or not write at these locations.

Each time a source is pulsed, there is an accompanying plasma jet or arc discharge between the plasma jet source or electrode and the particular point on the plate opposite to that source. The nozzle of each plasma jet source is of a precise diameter and length and is supplied with working gas, e.g. argon, at a precisely controlled pressure to provide a laminar flow (non-turbulent) discharge to the plate. The spark, plasma and accompanying heat etch or otherwise transform the surface of the plate in a controllable fashion to produce an image-forming spot or dot on the plate surface which is precisely defined in terms of shape and depth of penetration into the plate. In the case of an electrode, the working gas is supplied to the area surrounding the electrode to provide an improved conductive atmosphere for the arc discharge. The plate surface is similarly transformed to produce image-forming spots or dots.

The pulse duration, current or voltage controlling the arc at each source may be varied to produce a variable dot on the plate. Also, the polarity of the voltage applied to the plasma jet assembly may be made positive or negative depending upon the nature of the plate surface to be affected by the writing, i.e. depending upon whether ions need to be pulled from or repelled to the surface of the plate at each image point in order to transform the surface at that point to distinguish it imagewise from the remainder of the plate surface, e.g. to render it oleophilic in the case of positive writing on a plate whose surface is oleophobic. In this way, image spots can be written onto the plate surface that have diameters in the order of 0.005 inch all the way down to 0.0001 inch.

After a complete scan of the plate, then, the apparatus will have applied a complete screened image to the plate in the form of a multiplicity of surface spots or dots which are different in their affinity for ink from the portions of the plate surface not exposed to the spark discharges from the scanning electrode.

Thus, using our method and apparatus, high quality images can be applied to lithographic plates which have a variety of different plate surfaces suitable for either dry or wet offset printing. In all cases, the image is applied to the plate relatively quickly and efficiently and in a precisely controlled manner so that the image on the plate is an accurate representation of the printing on the original document. Actually using our technique, a lithographic plate can be imaged while it is mounted in its press thereby reducing set up time considerably. An even greater reduction in set up time results if the invention is practiced on plates mounted in a color press because correct color registration between the plates on the various print cylinders can be accomplished electronically rather than manually by controlling the timings of the input data applied to the plasma jet or electrode sources that write the images on the plates. As a consequence of the forgoing combination of features, our method and apparatus for applying images to lithographic plates should receive wide acceptance in the printing industry.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENTS

Figure 1:
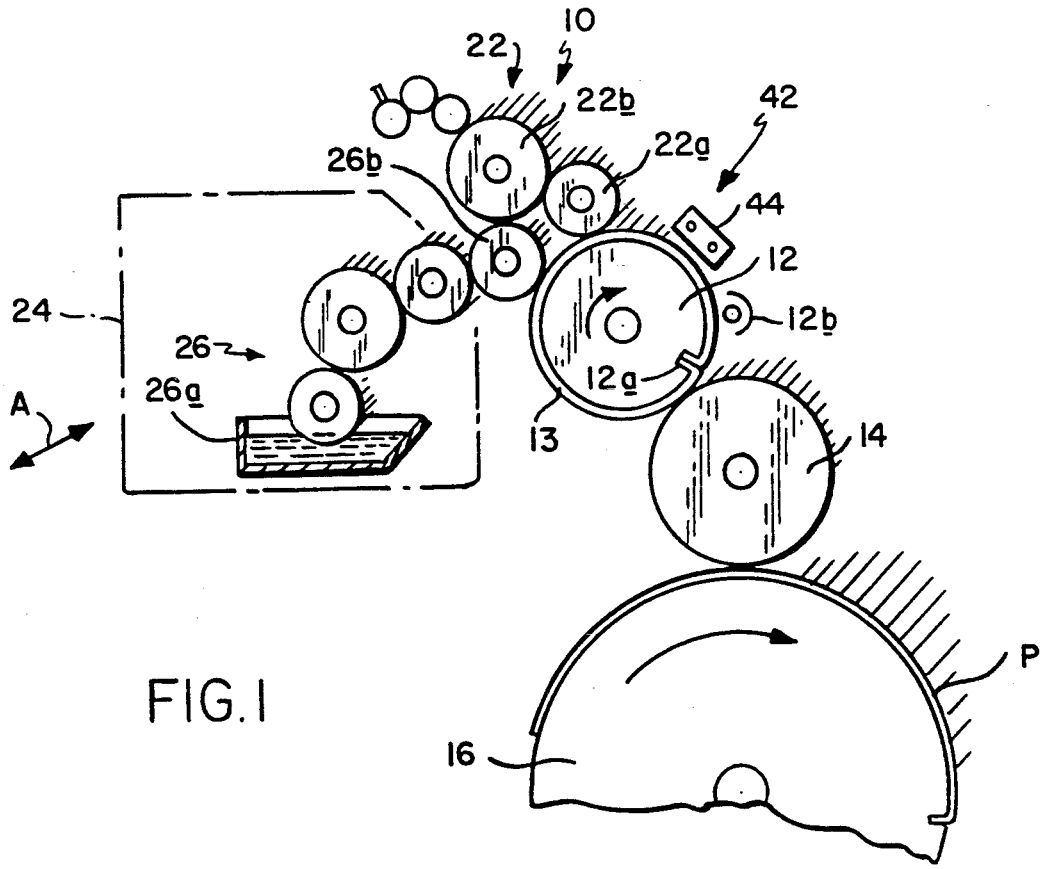
FIG. 1 is a diagrammatic view of an offset press incorporating a lithographic printing plate made in accordance with this invention.

Refer first to FIG. 1 of the drawings which shows a more or less conventional offset press shown generally at 10 which can print copies using lithographic plates made in accordance with this invention.

Press 10 includes a print cylinder or drum 12 around which is wrapped a lithographic plate 13 whose opposite edge margins are secured to the plate by a conventional clamping mechanism 12*a* incorporated into cylinder 12. Cylinder 12, or more precisely the plate 13 thereon, contacts the surface of a blanket cylinder 14 which, in turn, rotates in contact with a large diameter impression cylinder 16. The paper sheet P to be printed on is mounted to the surface of cylinder 16 so that it passes through the nip between cylinders 14 and 16 before being discharged to the exit end of the press 10. Ink for inking plate 13 is delivered by an ink train 22, the lowermost roll 22*a* of which is in rolling engagement with plate 13 when press 10 is printing. As is customary in presses of this type, the various cylinders are all geared together so that they are driven in unison by a single drive motor. This ink train may be used on a single color press as well as on a multiple color press.

The illustrated press 10 is capable of wet as well as dry printing. Accordingly, it includes a conventional dampening or water fountain assembly 24 which is movable toward and away from drum 12 in the directions indicated by arrow A in FIG. 1 between active and inactive positions. Assembly 24 includes a conventional water train shown generally at 26 which conveys water from a tray 26*a* to a roller 26*b* which, when the dampening assembly is active, is in rolling engagement with plate 13 and the intermediate roller 22*b* of ink train 22 as shown in FIG. 1.

Figure 4A:
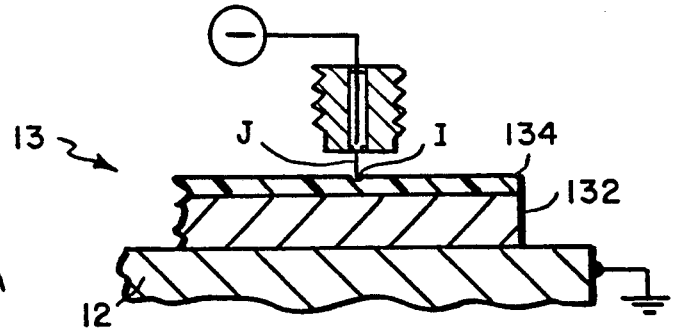
FIGS. 4A to 4D are enlarged sectional views showing lithographic plates imaged in accordance with our invention.

When press 10 is operating in its dry printing mode, the dampening assembly 24 is inactive so that roller 26*b* is retracted from roller 22*b* and the plate as shown in phantom in FIG. 1 and no water is applied to the plate. The lithographic plate 13 on cylinder 12, which is described in more detail in connection with FIG. 4A, is designed for such dry printing. It has a surface which is oleophobic or non-receptive to ink except in those areas that have been written on or imaged to make them oleophilic or receptive to ink. As the cylinder 12 rotates, the plate is contacted by the ink- coated roller 22*a* of ink train 22. The areas of the plate surface that have been written on and thus made oleophilic pick up ink from roller 22*a*. Those areas of the plate surface not written on receive no ink. Thus, after one revolution of cylinder 12, the image written on the plate will have been inked or developed. That image is then transferred to the blanket cylinder 14 and finally, to the paper sheet P which is pressed into contact with the blanket cylinder.

When press 10 is operating in its wet printing mode, the dampening assembly 24 is active so that the water roller 26*b* contacts ink roller 22*b* and the surface of the plate 13 as shown in FIG. 1. The lithographic plate in this case is designed for wet printing. See, for example, plate 152 in FIG. 4B. It has a surface which is ink receptive or oleophilic except in the areas thereof which have been written on to make them hydrophilic. Those areas, which correspond to the unprinted areas of the original document, accept water. In this mode of operation, as the cylinder 12 rotates (clockwise in FIG. 1), water and ink are presented to the surface of plate 13 by the rolls 26*b*, and 22*a*, respectively. The water adheres to the hydrophilic areas of that surface corresponding to the background of the original document and those areas, being coated with water, do not pick up ink from roller 22*a*. On the other hand, the oleophilic areas of the plate surface which have not been wetted by roller 26, pick up ink from roller 22*a*, again forming an inked image on the surface of the plate. As before, that image is transferred via blanket roller 14 to the paper sheet P on cylinder 16.

Figure 2:
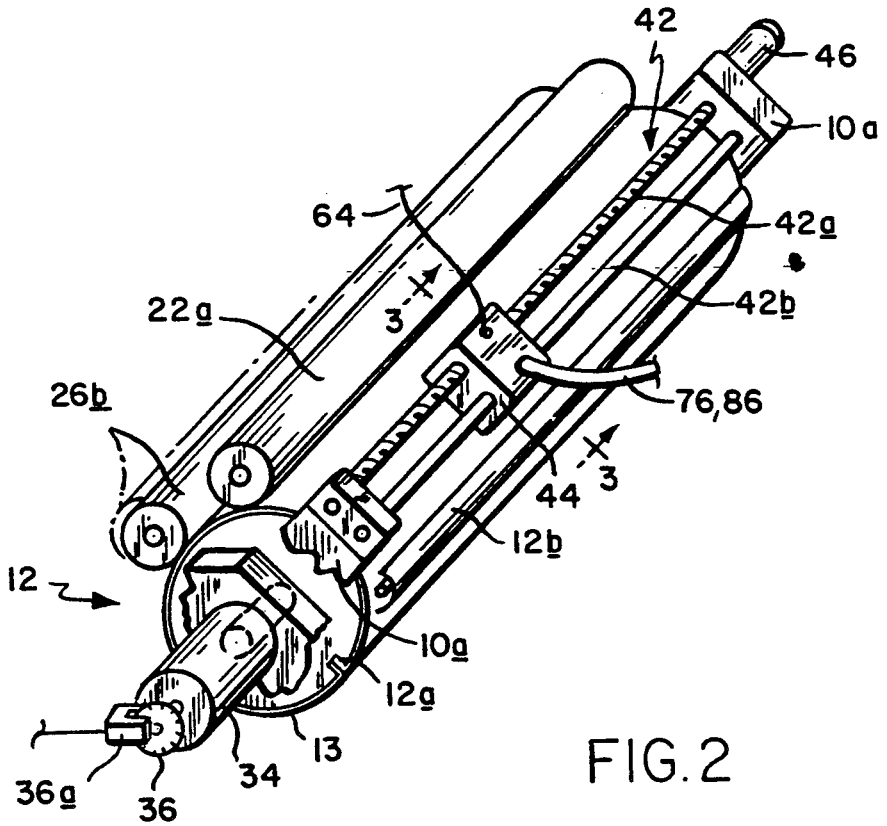
FIG. 2 is an isometric view on a larger scale showing in greater detail the print cylinder portion of the FIG. 1 press.

While the image to be applied to the lithographic plate 13 can be written onto the plate while the plate is "off press", our invention lends itself to imaging the plate when the plate is mounted on the print cylinder 12 and the apparatus for accomplishing this will now be described with reference to FIG. 2. As shown in FIG. 2, the print cylinder 12 is rotatively supported by the press frame 10*a* and rotated by a standard electric motor 34 or other conventional means. The angular position of cylinder 12 is monitored by conventional means such as a shaft encoder 36 that rotates with the motor armature and associated detector 36*a*. If higher resolution is needed, the angular position of the large diameter impression cylinder 16 may be monitored by a suitable magnetic detector that detects the teeth of the circumferential drive gear on that cylinder which gear meshes with a similar gear on the print cylinder to rotate that cylinder.

Also supported on frame 10*a* adjacent to cylinder 12 is a writing head assembly shown generally at 42. This assembly comprises a lead screw 42*a* whose opposite ends are rotatively supported in the press frame 10*a*, which frame also supports the opposite ends of a guide bar 42*b* spaced parallel to lead screw 42*a*. Mounted for movement along the lead screw and guide bar is a carriage 44. When the lead screw is rotated by a step motor 46, carriage 44 is moved axially with respect to print cylinder 12.

The cylinder drive motor 34 and step motor 46 are operated in synchronism by a controller 50 (FIG. 3), which also receives signals from detector 36*a*, so that as the drum rotates, the carriage 44 moves axially along the drum with the controller "knowing" the instantaneous relative position of the carriage and cylinder at any given moment. The control circuitry required to accomplish this is already very well known in the scanner and plotter art.

Figure 3:
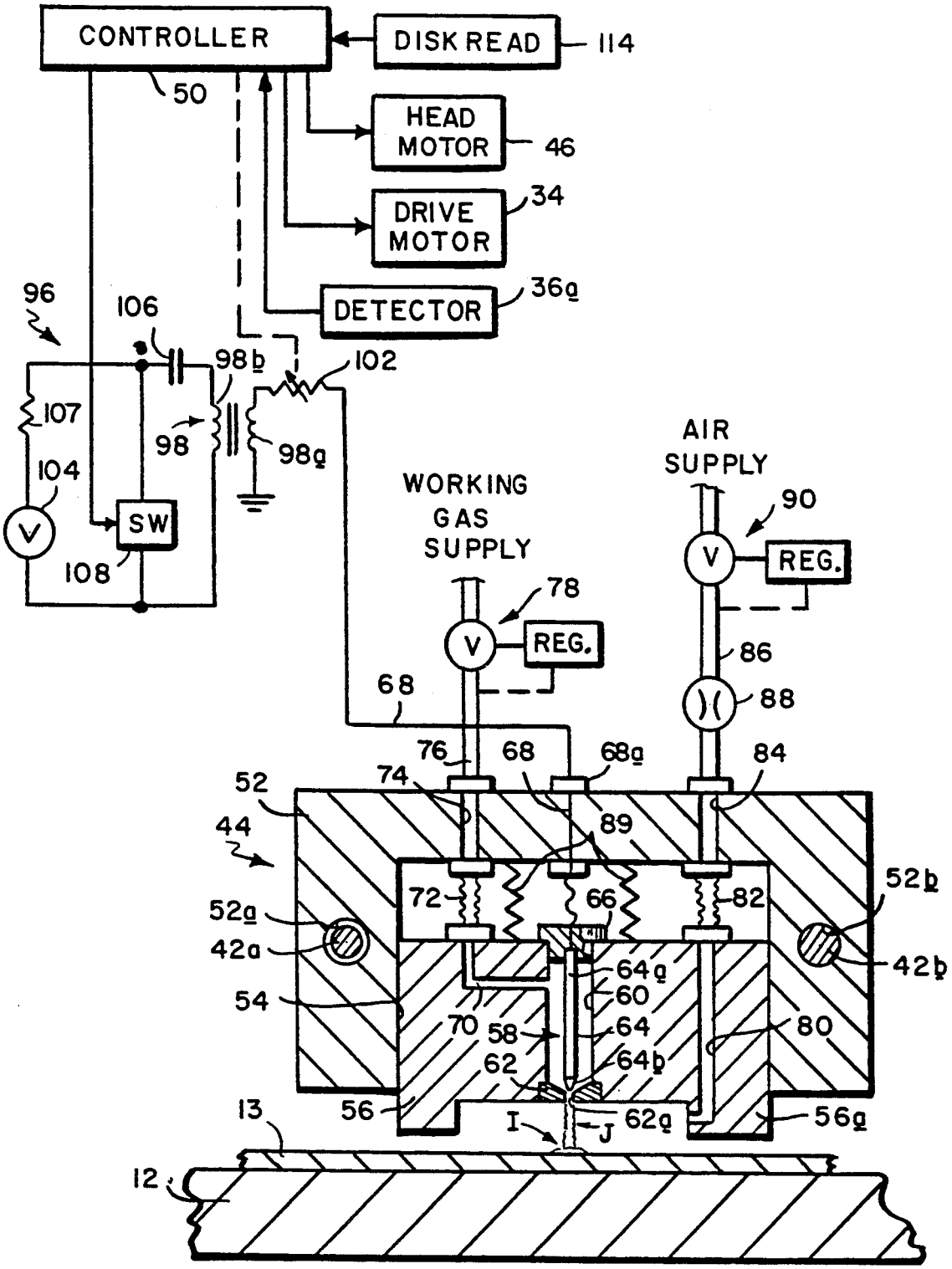
FIG. 3 is a sectional view taken along line 3—3 of FIG. 2 on a larger scale showing the writing head that applies an image to the surface of the FIG. 2 print cylinder, with the associated electrical components being represented in a block diagram.

Refer now to FIG. 3 which depicts an illustrative embodiment of carriage 44. It includes a block 52 having a threaded opening 52*a* for threadedly receiving the lead screw 42*a* and a second parallel opening 52*b* for slidably receiving underside of block 52 for slidably receiving a writing head 56 made of a suitable rigid electrical insulating material that supports an arc or plasma jet source. The illustrated head has only one such source 58 and is, therefore, capable of imaging only one point on plate 13 at a time. It should be understood, however, that the head may carry a plurality of such sources in which case it would image a corresponding plurality cf points on the plate simultaneously.

Source 58 comprises a vertical passage 60 that extends down through head 56. The lower end of passage 60 is partially closed by a nozzle 62 made of a refractory material such as ceramic, ruby or sapphire. Centered on the axis of passage 60 is an electrode 64 whose upper end 64*a* is supported by a conductive socket 66 plugged into the upper end of passage 60. Electrode 64 is made of a refractory metal such as tungsten, nichrome or the like capable of withstanding erosion due to spark discharges from the electrode. The lower end or tip 64*b* of the electrode is preferably pointed and is shown as extending slightly into the nozzle orifice 62*a*. In some cases, however, the electrode may be shorter so that its tip 64*b* is spaced from the nozzle 62. In still other cases, the nozzle 62 is omitted and the electrode is directly exposed to the plate surface with surrounding working gas flow. This is shown in FIG. 4D. An insulated conductor 68 connects socket 66 to a terminal 68*a* at the top of block 52.

A small gas passage 70 extends from the top of head 56 to passage 60 at a point below socket 66. The upper end of passage 70 is connected by a flexible tube 72 to a colinear passage 74 in block 52 that leads to the top of that block. The upper end of passage 74 is, in turn, connected by a pipe or supply tube 76 to a source of working gas such as argon, or one of the other inert gases. In some cases, as will be described later, the working gas may also include an oxidizing gas, e.g. oxygen.

The gas supply pressure to passage 60 is regulated by a pressure regulator 78 in supply tube 76 so as to provide a non-turbulent flow of gas to passage 60 for discharge through the nozzle orifice 62*a* or along the exposed electrode in heads that do not employ a nozzle orifice.

When the carriage 44 is positioned opposite plate 13 as shown in FIG. 3, head 56 is spaced a constant distance above the surface of the plate. To facilitate this, the head 56 is provided with a depending skirt or baffle 56*a*. Also, a gas passage 80 extends down from the top of head 56 into the skirt where it opens into the region within the skirt. The upper end of that passage 80 is connected by a flexible tube 82 to a vertical gas passage 84 in block 52. The upper end of that latter passage is, in turn, connected to a pipe or tube 86 leading from a source of pressured air. Preferably, the tube 86 contains a flow restrictor 88 and a pressure regulator 90 so that the resultant back pressure from the air flow through the gap between the plate and the skirt 56, acting over the area encompassed by the lower edge of skirt 56*a*, is sufficient to support the head 56 at a constant distance from the surface of plate 13. Typically, the head 56 is supported so that a constant gap in the range of 0.001 to 0.015 inch is maintained between the plate 13 surface and the nozzle 62 at the underside of the head.

The air discharging from passage 80 also performs other functions to be described later.

Still referring to FIG. 3, the writing head 56, and particularly the pulsing of electrode 64, is controlled by a pulse circuit 96. One suitable circuit comprises a transformer 98 whose secondary winding 98*a* is connected at one end by way of a fixed or variable resistor 102 to terminal 68*a* on block 52, which, as noted previously, is connected electrically to electrode 64. The opposite end of winding 98*a* is connected to electrical ground. The transformer primary winding 98*b* is connected to a DC voltage source 104 that supplies a voltage in the order of 1000 volts. The transformer primary circuit includes a capacitor 106 and a resistor 107 in series. The capacitor is maintained at full voltage by the resistor 107. An electronic switch 108 is connected in shunt with winding 98*b* and the capacitor. This switch is controlled by switching signals received from controller 50.

It should be understood that circuit 96 specifically illustrated is only one of many known circuits that can be used to provide variable high voltage pulses of short duration to electrode 64. For example, a high voltage switch and a capacitor-regenerating resistor may be used to avoid the need for transformer 98. Also, a bias voltage may be applied to the electrode 64 to provide higher voltage output pulses to the electrode without requiring a high voltage rating on the switch.

When an image is being written on plate 13, the press 10 is operated in a non-print or imaging mode with both the ink and water rollers 22*a* and 26*b* (FIG. 1) being disengaged from cylinder 12. The imaging of plate 13 in press 10 is controlled by controller 50 which, as noted previously, also controls the rotation of cylinder 12 and the scanning of the plate by carriage assembly 42. The signals for imaging plate 13 are applied to controller 50 by a conventional source of picture signals such as a disk reader 114. The controller 50 synchronizes the image data from disk reader 114 with the control signals that control rotation of cylinder 12 and movement of carriage 44 so that when the plasma jet source 58 is positioned over uniformly spaced image points on the plate 13, switch 108 is either closed or not closed depending upon whether that particular point is to be written on or not written on.

If that point is not to be written on, (i.e. in direct writing it corresponds to a location in the background of the original document, in indirect writing it corresponds to a point in the printed area of the document), the source electrode 64 is not pulsed and proceeds to the next image point. On the other hand, if that point in the plate does correspond to a location on the plate which is to be written on (i.e. the printed area for direct writing; the background area for indirect writing), switch 108 is closed. The closing of that switch discharges capacitor 106 so that a high voltage pulse, i.e. 1000 volts, of only about one microsecond duration is applied to transformer 98. The transformer applies a stepped-up pulse of about 3000 volts to electrode 64 causing a plasma jet discharge or electric arc J between the source tip 64*b* and plate 13. That is, each such pulse strikes a spark between the electrode tip 64*b* and plate 13 causing ionization and disassociation of the working gas molecules in passage 60 thereby creating a small diameter plasma jet discharge through nozzle orifice 62*a* to the plate surface, or directly from the electrode tip 64*b* in head configurations not employing a nozzle 62.

The source nozzle 62 is provided with an orifice 62*a* in the order of 0.002 to 0.010 inch in diameter to provide a sufficient flow of working gas at the regulated pressure, i.e. 1 to 4 psi, to provide a non-turbulent plasma gas jet discharge to plate 13 of sufficient momentum to function essentially as a compliant conductive path between electrode 64 and plate 13. That plasma discharge, including the accompanying arc and attendant heat, etches or transforms a small spot of the desired size on the surface of the plate at the image point I thereon directly opposite the nozzle orifice 62*a*. This transformation renders that point either receptive or non-receptive to ink, depending upon the type of surface on the plate. A similar process takes place with an exposed electrode but without the advantage of the energy focusing gas jet.

In addition to providing an air cushion for head 56 as the head is moved along the surface of plate 13, the air discharging from passage 80 into the gap between the head and the plate purges that space of debris produced by the etching or transformation process. The air is also a source of oxygen which, in the case of some plates, abets or enhances the imaging or writing by the plasma jet source 58.

The transformations that do occur with our different lithographic plate constructions will be described in more detail later. Suffice it to say at this point, that resistor 102 is adjusted for the different plate embodiments to produce a plasma jet or electric arc discharge J that writes a clearly defined image spot on the plate surface which is in the order of 0.0001 to 0.005 inch in diameter. That resistor 102 may be varied manually or automatically via controller 50 to produce dots of variable size. Dot size may also be varied by changing the voltage and/or duration of the pulses that produce the plasma jet or electric arc discharges. Means for doing this are quite well known in the art. Likewise, dot size may be varied by repeated pulsing of the plasma jet or electric arc source at each image point, the number of pulses determining the dot size (pulse count modulation). The polarity of the voltage applied to the electrode 64 may be positive or negative although preferably, the polarity is selected according to whether ions need to be pulled from or repelled to the plate surface to effect the desired surface transformations on the various plates to be described.

As the plasma jet source 58 or the exposed electrode 64 is scanned across the plate surface, it can be pulsed at a maximum rate of about 500,000 pulses/sec. However, a more typical rate is 25,000 pulses/sec. Thus, a broad range of dot densities can be achieved, e.g. 2,000 dots/inch to 50 dots/inch. The dots can be printed side-by-side or they may be made to overlap so that substantially 100% of the surface area of the plate can be imaged. Thus, in response to the incoming data, an image corresponding to the original document builds up on the plate surface constituted by the points or spots on the plate surface that have been etched or transformed by the plasma jet discharge J, as compared with the areas of the plate surface that have not been so affected by the discharge.

In the case of axial scanning, then, after one revolution of print cylinder 12, a complete image will have been applied to plate 13. The press 10 can then be operated in its printing mode by moving the ink roller **22*a* to its inking position shown in FIG. 1, and, in the case of wet printing as with plate 152 in FIG. 4B, by also shifting the water fountain roller 26*b* to its position shown in FIG. 1 and in solid lines in FIG. 2. As the plate rotates, ink will adhere only to the image points written onto the plate that correspond to the printed portion of the original document (in the case of direct writing), or the background portion (in the case of indirect writing). That ink image will then be transferred in the usual way via blanket cylinder 14 to the paper sheet P mounted to cylinder 16**.

Forming the image on the plate 13 while the plate is on the cylinder 12 provides a number of advantages, the most important of which is the significant decrease in the preparation and set up time, particularly if the invention is incorporated into a multi-color press. Such a press includes a plurality of sections similar to press 10 described herein, one for each color being printed. Whereas normally the print cylinders in the different press sections after the first are adjusted axially and in rotation phase so that the different color images printed by the lithographic plates in the various press sections will appear in register on the printed copies, it is apparent from the foregoing that, since the images are applied to the plates 13 while they are mounted in the press sections, such print registration can be accomplished electronically in the present case.

More particularly, in a multicolor press, incorporating a plurality of press sections similar to press 10, the controller 50 would adjust the timings of the picture signals controlling the writing of the images at the second and subsequent printing sections to write the image on the lithographic plate 13 in each such station with an axial and/or angular offset that compensates for any misregistration with respect to the image on the first plate 13 in the press. In other words, instead of achieving such registration by repositioning the print cylinders or plates, the registration errors are accounted for when writing the images on the plates. Thus once imaged, the plates will automatically print in perfect register on paper sheet P.

Refer now to FIGS. 4A to 4D which illustrate various lithographic plate embodiments which are capable of being imaged by the apparatus depicted in FIGS. 1 to 3. The plate embodiment 13 in FIG. 4A is suitable for direct imaging in a press without dampening. Plate 13 comprises a substrate 132 made of a conductive metal such as aluminum or steel. The substrate carries a thin coating 134 of a highly oleophobic material such as a fluoropolymer or silicone characterized by low surface energy. One suitable coating material is an addition-cured silicone release coating marketed by Dow Corning under its designation SYL-OFF 7044. Plate 130 is written on or imaged by decomposing the surface of coating 134 using the plasma jet or electric arc discharges J from source 58. The heat from the associated arc decomposes the silicone coating into silicon dioxide, carbon dioxide, and water. Hydrocarbon fragments in trace amounts are also possible depending on the chemistry of the silicone polymers used. For other substrate materials, the presence of a oxidant in the space above image point I facilitates and abets the decomposition process.

Such decomposition coupled with surface alterations of coating 134 due to the plasma jet or electric arc discharge J renders that surface oleophilic at each image point I directly opposite the nozzle orifice **62*a*. Preferably that coating is made quite thin, e.g. 0.0003 inch to minimize the voltage required to break down the material to render it ink receptive. Resultantly, when plate 13 is inked by roller 22*a* in press 10, ink adheres only to those transformed image points I on the plate surface. Areas of the plate not so imaged, corresponding to the background area of the original document to be printed, do not pick up ink from roll 22*a*. The inked image on the plate is then transferred by blanket cylinder 14** to the paper sheet P as in any conventional offset press.

Figure 4B:
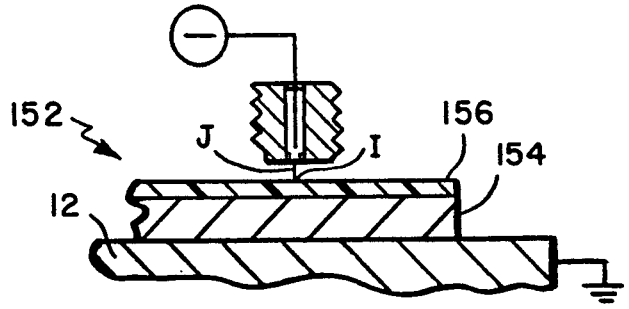

FIG. 4B illustrates a lithographic plate 152 suitable for indirect or background imaging and for wet printing. The plate 152 comprises a substrate 154 made of a suitable conductive metal such as aluminum or copper. Applied to the surface of substrate 154 is a layer 156 of phenolic resin, parylene, diazo-resin, photopolymer or other such material to which oil and rubber-based inks adhere readily. Suitable positive working, subtractive plates of this type are available from the Enco Division of American Hoechst Co. under that company's designation P-800.

When the coating 156 is subjected to a direct electric discharge from the electrode 64 or a plasma jet discharge J from nozzle 62, the image point I on the surface of layer 156 opposite the nozzle orifice **62*a* is altered by various electrochemical reactions and by contact with ozone generated by the arc from source 58 to that image point such that the image point readily accepts water. Actually, if layer 156 is thick enough and conductive, substrate 154 may simply be a separate flat electrode member disposed opposite the source 58. Accordingly, when the plate 152 is coated with water and ink by the rolls 26*b* and 22*a*, respectively, of press 10, water adheres to the image points I on plate 152 formed by the discharges J from the plasma jet or electric arc source 58. Ink, on the other hand, shuns those water-coated surface points on the plate corresponding to the background or non-printed areas of the original document and adheres only to the non-imaged areas of plate 152**.

Figure 4C:
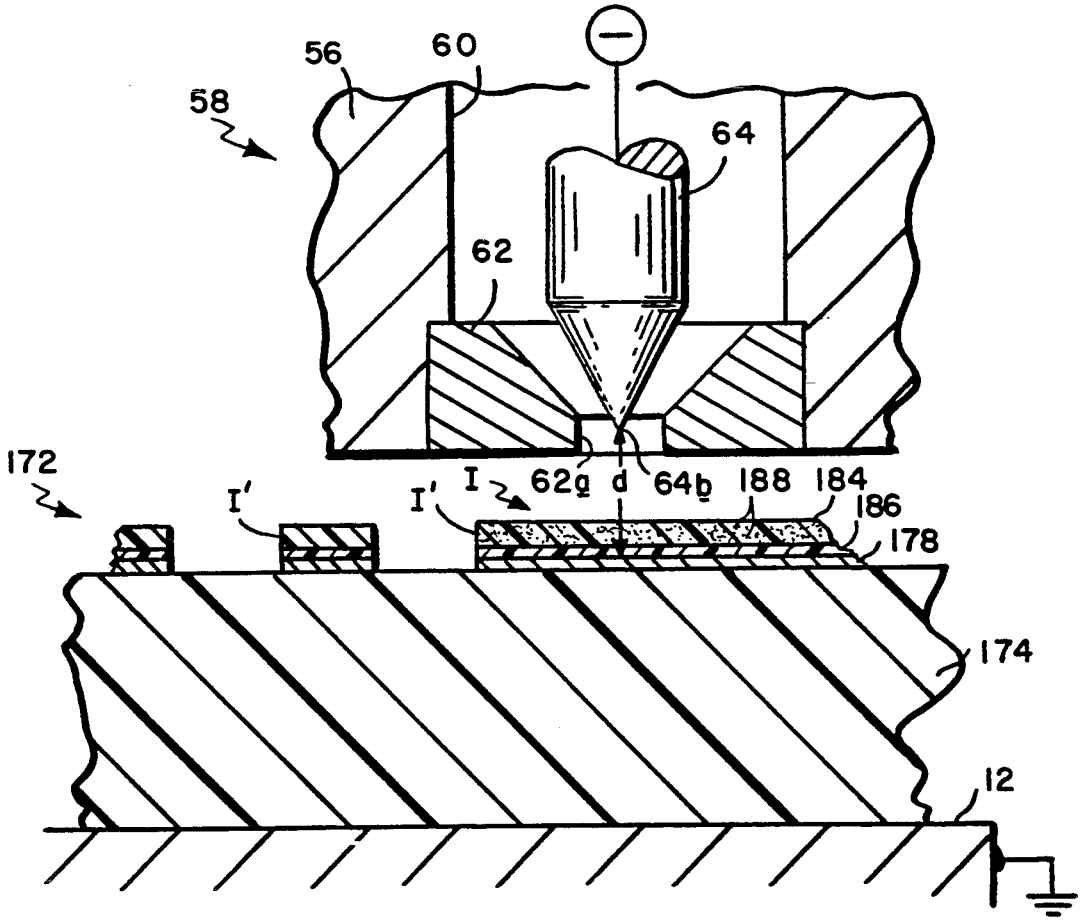
Figure 4D:
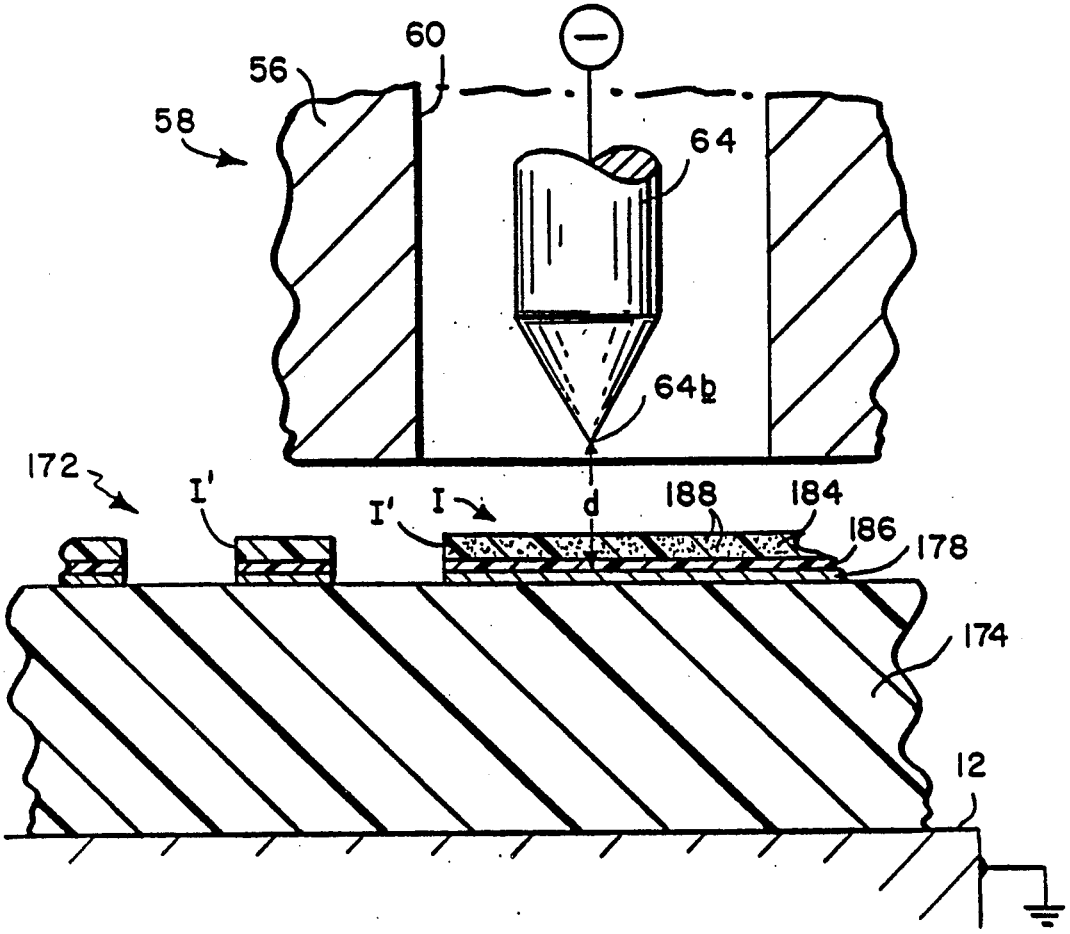

Refer now to FIG. 4C which illustrates a plate embodiment 172 also suitable for direct imaging and for use in an offset press without dampening. We have found that this novel plate 172 actually produces the best results of all of the plates described herein in terms of the quality and useful life of the image impressed on the plate.

Plate 172 comprises a base or substrate 174, a thin conductive metal layer 178, an ink repellent silicone top or surface layer 184, and, if necessary, a primer layer 186 between layers 178 and 184. In some cases, there may also be a base layer (not shown) having a textured or rough surface topology produced by filler particles and located between substrate 174 and metal layer 178 so that the surface of plate 172 has numerous peaks and valleys, the former constituting point source electrodes for the arc from source 58. Suitable base coat materials include aziridines and two-part isocynate-based urethanes in which the isocynate component reacts with a polyol component such as a polyether or polyester. The particles may be graphite, carbon-black, metal powder or the like. For a detailed description of base coat chemistry, see co-pending U.S. Pat. No. 4,911,075, the contents of which are incorporated herein by reference.

1. Substrate 174

The material of substrate 174 should be oleophilic and have mechanical strength, lack of extension (stretch) and heat resistance. Polyester film meets all these requirements well and is readily available. Dupont's Mylar and ICI's Melinex are two commercially available films. Other films that can be used for substrate 174 are those based on polyimides (Dupont's Kapton) and polycarbonates (GE's Lexan). A preferred thickness is 0.005 inch, but thinner and thicker versions can be used effectively.

There is no requirement for an optically clear film or a smooth film surface (within reason). The use of pigmented films including films pigmented to the point of opacity are feasible for the substrate, providing mechanical properties are not lost.

2. Thin Metal Layer 178

This layer 178 is important to formation of an image and must be uniformly present if uniform imaging of the plate is to occur. The image carrying (i.e. ink receptive) areas of the plate 172 are created when the electric arc or plasma jet discharge J volatizes a portion of the thin metal layer 178. The size of the feature formed by the electric arc or plasma jet discharge from source tip **58*b*** of a given energy is a function of the amount of metal that is volatized. This is, in turn, a function of the amount of metal present and the energy required to volatize the metal used. An important modifier is the energy available from oxidation of the volatized metal (i.e. that can contribute to the volatizing process), an important partial process present when most metals are vaporized into a routine or ambient atmosphere.

The metal preferred for layer 178 is aluminum, which can be applied by the process of vacuum metallization (most commonly used) or sputtering to create a uniform layer 300+/−100 Angstroms thick. Other suitable metals include chrome, copper and zinc. In general, any metal or metal mixture, including alloys, that can be deposited on base coat 176 can be made to work, a consideration since the sputtering process can then deposit mixtures, alloys, refractories, etc. Also, the thickness of the deposit is a variable that can be expanded outside the indicated range. That is, it is possible to image a plate through a 1000 Angstrom layer of metal, and to image layers less than 100 Angstroms thick. The use of thicker layers reduces the size of the image formed, which is desirable when resolution is to be improved by using smaller size images, points or dots.

3. Primer 186 (when required)

The primer layer 186 anchors the ink repellent silicone coating 184 to the thin metal layer 178. Effective primers include the following:

(a) silanes (monomers and polymeric forms)
(b) titanates
(c) polyvinyl alcohols
(d) polyimides and polyamide-imides Silanes and titanates are deposited from dilute solutions, typically 1–3% solids, while polyvinyl alcohols, polyimides, and polyamides-imides are deposited as thin films, typically 3±1 microns. The techniques for the use of these materials is well known in the art.

4. Ink Repellent Silicone Surface Layer 184

As pointed out in the background section of the application, the use of a coating such as this is not a new concept in offset printing plates. However, many of the variations that have been proposed previously involve a photosensitizing mechanism. The two general approaches have been to incorporate the photoresponse into a silicone coating formulation, or to coat silicone over a photosensitive layer. When the latter is done, photoexposure either results in firm anchorage of the silicone coating to the photosensitive layer so that it will remain after the developing process removes the unexposed silicone coating to create image areas (a positive working, subtractive plate) or the exposure destroys anchorage of the silicone coating to the photosensitive layer so that it is removed by "developing" to create image areas leaving the unexposed silicone coating in place (a negative working, subtractive plate). Other approaches to the use of silicone coatings can be described as modifications of xerographic processes that result in an image-carrying material being implanted on a silicone coating followed by curing to establish durable adhesion of the particles.

Plates marketed by IBM Corp. under the name Electroneg use a silicone coating as a protective surface layer. This coating is not formulated to release ink, but rather is removable to allow the plates to be used with dampening water applied.

The silicone coating here is preferably a mixture of two or more components, one of which will usually be a linear silicone polymer terminated at both ends with functional (chemically reactive) groups. Alternatively, in place of a linear difunctional silicone, a copolymer incorporating functionality into the polymer chain, or branched structures terminating with functional groups may be used. It is also possible to combine linear difunctional polymers with copolymers and/or branch polymers. The second component will be a multifunctional monomeric or polymeric component reactive with the first component. Additional components and types of functional groups present will be discussed for the coating chemistries that follow.

(a) Condensation Cure Coatings are usually based on silanol (—Si—OH) terminated polydimethylsiloxane polymers (most commonly linear). The silanol group will condense with a number of multifunctional silanes. Some of the reactions are:

| Functional Group | Reaction | By Product |
|---|---|---|
| Acetoxy | $-\overset{\vert}{\underset{\vert}{Si}}-OH + RCO-\overset{\vert}{\underset{\vert}{Si}}- \longrightarrow -\overset{\vert}{\underset{\vert}{Si}}-O-\overset{\vert}{\underset{\vert}{Si}}- +$ | $HOC(=O)R$ |
| Alkoxy | $-\overset{\vert}{\underset{\vert}{Si}}-OH + RO-\overset{\vert}{\underset{\vert}{Si}}- \longrightarrow -\overset{\vert}{\underset{\vert}{Si}}-O-\overset{\vert}{\underset{\vert}{Si}}- +$ | HOR |
| Oxime | $-\overset{\vert}{\underset{\vert}{Si}}-OH + R_1R_2C{=}NO-\overset{\vert}{\underset{\vert}{Si}}- \longrightarrow -\overset{\vert}{\underset{\vert}{Si}}-O-\overset{\vert}{\underset{\vert}{Si}}- +$ | $HON{=}CR_1R_2$ |

Catalysts such as tin salts or titanates can be used to accelerate the reaction. Use of low molecular weight groups such as $CH_3$— and $CH_3CH_2$— for $R_1$ and $R_2$ also help the reaction rate yielding volatile byproducts easily removed from the coating. The silanes can be difunctional, but trifunctional and tetrafunctional types are preferred.

Condensation cure coatings can also be based on a moisture cure approach. The functional groups of the type indicated above and others are subject to hydrolysis by water to liberate a silanol functional silane which can then condense with the silanol groups of the base polymer. A particularly favored approach is to use acetoxy functional silanes, because the byproduct, acetic acid, contributes to an acidic environment favorable for the condensation reaction. A catalyst can be added to promote the condensation when neutral byproducts are produced by hydrolysis of the silane.

Silanol groups will also react with polymethyl hydrosiloxanes and polymethylhydrosiloxane copolymers when catalyzed with a number of metal salt catalysts such as dibutyltindiacetate. The general reaction is:

$$-\overset{\vert}{\underset{\vert}{Si}}-OH + H-\overset{\vert}{\underset{\vert}{Si}}- \xrightarrow[\text{catalyst}]{} -\overset{\vert}{\underset{\vert}{Si}}-O-\overset{\vert}{\underset{\vert}{Si}}- + H_2$$

This is a preferred reaction because of the requirement for a catalyst. The silanol terminated polydimethylsiloxane polymer is blended with a polydimethylsiloxane second component to produce a coating that can be stored and which is catalyzed just prior to use. Catalyzed, the coating has a potlife of several hours at ambient temperatures, but cures rapidly at elevated temperatures such as 300° F. Silanes, preferably acytoxy functional, with an appropriate second functional group (carboxy phoshonated, and glycidoxy are examples) can be added to increase coating adhesion. A working example follows.

(b) Addition Cure Coatings are based on the hydrosilation reaction; the addition of Si—H to a double bond catalyzed by a platinum group metal complex. The general reaction is:

$$-\overset{\vert}{\underset{\vert}{Si}}-H + CH_2{=}CH-\overset{\vert}{\underset{\vert}{Si}}- \xrightarrow[\text{catalyst}]{} -\overset{\vert}{\underset{\vert}{Si}}-CH_2CH_2-\overset{\vert}{\underset{\vert}{Si}}-$$

Coatings are usually formulated as a two part system composed of a vinyl functional base polymer (or polymer blend) to which a catalyst such as a chloroplantinic acid complex has been added along with a reaction modifier(s) when appropriate (cyclic vinyl-methylsiloxanes are typical modifiers), and a second part that is usually a polymethylhydrosiloxane polymer or copolymer. The two parts are combined just prior to use to yield a coating with a potlife of several hours at ambient temperatures that will cure rapidly at elevated temperatures (300° F., for example). Typical base polymers are linear vinyldimethyl terminated polydimethylsiloxanes and dimethysiloxanevinylmethylsiloxane copolymers. A working example follows.

(c) Radiation Cure Coatings can be divided into two approaches. For U.V. curable coatings, a cationic mechanism is preferred because the cure is not inhibited by oxygen and can be accelerated by post U.V. exposure application of heat. Silicone polymers for this approach utilize cycloaliphatic epoxy functional groups. For electron beam curable coatings, a free radical cure mechanism is used, but requires a high level of inerting to achieve an adequate cure. Silicone polymers for this approach utilize acrylate functional groups, and can be crosslinked effectively by multifunctional acrylate monomers.

Preferred base polymers for the surface coatings 184 discussed are based on the coating approach to be used. When a solvent based coating is formulated, preferred polymers are medium molecular weight, difunctional polydimethylsiloxanes, or difunctional polydimethylsiloxane copolymers with dimethylsiloxane composing 80% or more of the total polymer. Preferred molecular weights range from 70,000 to 150,000. When a 100% solids coating is to be applied, lower molecular weights are desirable, ranging from 10,000 to 30,000. Higher molecular weight polymers can be added to improve coating properties, but will comprise less than 20% of the total coating. When addition cure or condensation cure coatings are to be formulated, preferred second components to react with silanol or vinyl functional groups are polymethylhydrosiloxane or a polymethylhydrosiloxane copolymer with dimethylsiloxane.

In some cases, particularly when plate 172 does not include a base layer, it is desirable to incorporate selected filler pigments 188 into the surface layer 184 as shown in FIG. 4C to support the imaging process. These particles provide supplemental oxidation energy which assists in the decomposition or transformation of the surface layer 184 by source 58. The useful pigment materials are diverse, including:

(a) aluminum powders
(b) molybdenum disulfide powders
(c) synthetic metal oxides
(d) silicon carbide powders
(e) graphite
(f) carbon black Preferred particle sizes for these materials are small, having average or mean particle sizes considerably less than the thickness of the applied coating (as dried and cured). For example, when an 8 micron thick coating 184 is to be applied, preferred sizes are less than 5 microns and are preferably, 3 microns or less. For thinner coatings, preferred particle sizes are decreased accordingly. Particle 188 geometries are not an important consideration. It is desirable to have all the particles present enclosed by the coating 184 because particle surfaces projecting at the coating surface have the potential to decrease the ink release properties of the coating. Total pigment content should be 20% or less of the dried, cured coating 184 and preferably, less than 10% of the coating. An aluminum powder supplied by Consolidated Astronautics as 3 micron sized particles has been found to be satisfactory. Contributions to the imaging process by the filler particles 188 are believed to be conductive ions that support the arc from the directly exposed electrode or plasma jet source 58 during its brief existence, and considerable energy release from the highly exothermic oxidation that is also believed to occur, the liberated energy contributing to decomposition and volatilization of material in the region of the image forming on the plate.

The ink repellent silicone surface coating 184 may be applied by any of the available coating processes. One consideration not uncommon to coating processes in general, is to produce a highly uniform, smooth, level coating.

Working Examples of Ink Repellent Silicone Coatings

1. Commercial Condensation cure coating supplied by Dow Corning:

| Component | Type | Parts |
|---|---|---|
| Syl-Off 294 | Base Coating | 40 |
| VM&P Naptha | Solvent | 110 |
| Methyl Ethyl Ketone | Solvent | 50 |
| Aliminum Powder | Filler Pigment | 1 |
| | Blend/Disperse Powder/Then Add: | |
| Syl-Off 297 | Acetoxy Functional Silane | 1.6 |
| | Blend Then Add: | |
| XY-176 Catalyst | Dibutyltindiacetate | 1 |
| | Blend/Then Use | |
| Apply with a #10 Wire Wound Rod | | |
| Cure at 300° F. for 1 minute | | |

2. Commercial addition cure coating supplied by Dow Corning:

| Component | Type | Parts |
|---|---|---|
| Syl-Off 7600 | Base Coating | 100 |
| VM-P Naptha | Solvent | 80 |
| Methyl Ethyl Ketone | Solvent | 40 |
| Aliminum Powder | Filler Pigment | 7.5 |
| | Blend/Disperse Powder/Then Add: | |
| Syl-Off 7601 | Crosslinker | 4.8 |
| | Blend/Then Use: | |
| Apply with a #4 Wire Wound Rod | | |
| Cure at 300° F. for 1 minute | | |

This coating can also be applied as a 100% solids coating (same formula without solvents) via offset gravure and cured using the same conditions.

3. Lab coating formulations illustrating condensation cure and addition cure coatings are given in the following Table 1. Identity of indicated components are given in the following Table 2. All can be applied by coating with wire wound rods and cured in a convection oven set at 300° F. using a 1 minute dwell time. Coating 4 can be applied as a 100% solids coating and cured under the same conditions.

TABLE 1

| | Condensation Cure Coatings | | | Addition Cure Coatings | | | | |
|---|---|---|---|---|---|---|---|---|
| Formulation : Parts Basis | 1 | 2 | 3 | 4 | 5 | 6 | 7 | 8 |
| Components | | | | | | | | |
| PS - 345.5 | 20 | 20 | — | — | — | — | — | — |
| PS - 347.5 | — | — | 20 | — | — | — | — | — |
| PS - 424 | — | — | — | — | 50 | — | — | — |
| PS - 442 | — | — | — | 64 | — | — | — | — |
| PS - 445 | — | — | — | — | — | 50 | — | — |
| PS - 447.6 | — | — | — | — | — | — | 50 | 50 |
| PS - 120 | 2 | — | 2 | 2 | 4 | 1 | 1 | — |
| PS - 123 | — | 6 | — | — | — | — | — | 2 |
| T - 2160 | — | — | — | 1 | 1 | — | — | — |
| Sly-OFF 297 | 2 | 2 | 2 | — | — | — | — | — |
| Dibutyltindiacetate | 1.2 | 1.2 | 1.2 | — | — | — | — | — |
| PC - 085 | — | — | — | 0.05 | 0.05 | 0.05 | 0.1 | 0.1 |
| VM & P Naptha | 118 | 114 | 140 | 64 | 55 | 100 | 133 | 133 |
| Methyl Ethyl Ketone | 60 | 60 | 75 | — | 55 | 50 | 67 | 67 |
| Aluminum Powder | 2 | 2 | 2 | 4 | 3 | 3 | 3 | 3 |

TABLE 2

| Component | Type | Molecular Weight | Supplier |
|---|---|---|---|
| PS - 345.5 | Silanol Terminated Polydimethylsiloxane | 77000 | Petrarch Systems |
| PS - 347.5 | Silanol Terminated Polydimethylsiloxane | 110000 | Petrarch Systems |
| PS - 424 | Dimethylsiloxane - Vinymethylsiloxane Copolymer 7.5% Vinylmethyl Comonomer | | Petrarch Systems |
| PS - 442 | Vimyldimethyl Terminated Polydimethylsiloxane | 17000 | Petrarch Systems |
| PS - 445 | Vimyldimethyl Terminated Polydimethylsiloxane | 63000 | Petrarch Systems |
| PS - 447.6 | Vimyldimethyl Terminated Polydimethylsiloxane | 118000 | Petrarch Systems |
| PS - 120 | Polymethylhydrosiloxane | 2270 | Petrarch Systems |
| PS - 123 | (30-35% Mehylhydro - (65-70%) Dimethylsiloxane Copolymer | 2000–2100 | Petrarch Systems |
| T - 2160 | 1,3,5,7 Tetravinyltetramethylcyclotetrasiloxane | | Petrarch Systems |
| Syl - Off 297 | Acetoxy Functional Silane | | Dow Corning |
| PC - 085 | Platinum - Cyclvinylmethylsiloxane Complex | | Petrarch Systems |
| | | | Petrarch Systems |

When plate 172 is subjected to a writing operation as described above, the directly exposed electrode 64 or plasma jet source 58 is pulsed, preferably negatively, at each image point I on the surface of the plate. Each such pulse creates a plasma jet or electric arc discharge J between the nozzle orifice, 62*a* or the electrode 64, and the plate, and more particularly across the small gap d between the electrode tip 64*b* and the metallic underlayer 178 of the plate. The discharge J etches or erodes away the ink repellent outer layer 178 (including its primer layer 186, if present) and the metallic underlayer 178 at the point I directly opposite the nozzle orifice 62*a*, or the electrode 64, thereby creating a well I' at that image point which exposes the underlying oleophyllic surface of substrate 176. The pulses to the plasma jet source 58 should be very short, e.g. 0.5 microseconds to avoid arc "fingering" along layer 178 and consequent melting of that layer around point I. The total thickness of layers 178, 186 and 178, i.e. the depth of well I', should not be so large relative to the width of the image point I that the well I, will not accept conventional offset inks and allow those inks to offset to the blanket cylinder 14 when printing.

Plate 172 is used in press 10 with the press being operated in its dry printing mode. The ink from ink roller 22*a* will adhere to the plate only at the image points I thereby creating an inked image on the plate that is transferred via blanket roller 14 to the paper sheet P carried on cylinder 16.

Instead of providing a separate metallic underlayer 178 in the plate as in FIG. 4C, it is also feasible to use a conductive plastic film for the conductive layer. A suitable conductive material for layer 178 should have a volume resistivity of 100 ohm centimeters or less, Dupont's Kapton film being one example. This is an experimental film in which the normally nonconductive material has been filled with conductive pigment to create a conductive film.

All of the lithographic plates described above can be imaged on press 10 or imaged off press by means of the plasma jet imaging apparatus described above. The described plate constructions in to provide both direct and indirect writing capabilities and they should suit the needs of printers who wish to make copies on both wet and dry offset presses with a variety of conventional inks. In all cases, no subsequent chemical processing is required to develop or fix the images on the plates. The coaction and cooperation of the plates and the imaging apparatus described above thus provide, for the first time, the potential for a fully automated printing facility which can print copies in black and white or in color in long or short runs in a minimum amount of time and with a minimum amount of effort.

It will thus be seen that the objects set forth above, among those made apparent from the preceding description, are efficiently attained. Also, certain changes may be made in carrying out the above process, in the described products, and in the constructions set forth without departing from the scope of the invention. For example, in the case of certain plates, it may be possible to operate the plasma jet source in a non-transferred mode in which the arc impinges the wall of the nozzle 62 which functions as an electrode (i.e. is conductive). In this event, the plasma, but not the arc, is projected as a jet beyond the nozzle to the surface of the lithographic plate. Therefore, it is intended that all matter contained in the above description or shown in the accompanying drawings shall be interpreted as illustrative and not a limiting sense.

It is also to be understood that the following claims are intended to cover all of the generic and specific features of the invention herein described.

We claim:

1. A method of imaging on a press including a plate cylinder, a lithographic plate having a printing surface and including a metal layer and a second layer underlying said metal layer, said metal and second layers having different affinities for a printing liquid selected from the group consisting of water and ink, said method comprising the steps of:

mounting said plate to the plate cylinder;

without contacting said printing surface, exposing the metal layer to ionized plasma discharges from a plasma-jet discharge source spaced close to said printing surface at selected points thereon to remove said metal layer and expose said second layer at the selected points;

moving the discharge source and the print cylinder relatively to effect a scan of the printing surface by the discharge source; and controlling the plasma discharges in accordance with picture signals representing an image so that they occur at selected times in the scan, thereby directly producing on the lithographic plate an array of image spots suitable for reproduction that corresponds to the picture represented by the picture signals.

2. The method of claim 1 wherein the exposing step is accomplished by plasma discharge through a source that comprises a nozzle and a cathode inside the nozzle, the nozzle having an exit means that focuses the discharge on a precisely defined plate area.

3. A method of imaging on a press including a plate cylinder, a lithographic plate having a printing surface and including an oleophobic first layer, a metal second layer underlying said first layer, and an oleophilic third layer underlying said second layer, said method comprising the steps of:

mounting said plate to the plate cylinder;

without contacting said printing surface, exposing the first and second layers to ionized plasma discharges from a plasma-jet discharge source spaced close to said printing surface at selected points thereon to remove said first and second layers at the selected points, thereby exposing said third layer;

moving the discharge source and the print cylinder relatively to effect a scan of the printing surface by the electrode, and controlling the plasma discharges in accordance with picture signals representing an image so that they occur at selected times in the scan, thereby directly producing on the lithographic plate an array of image spots suitable for reproduction that corresponds to the picture represented by the picture signals.

4. The method of claim 3 wherein the exposing step is accomplished by plasma discharge through a source that comprises a nozzle and a cathode inside the nozzle, the nozzle having an exit means that focuses the discharge on a precisely defined plate area.

5. A method imaging a lithographic plate having a printing surface and including a metal layer and a second layer underlying said metal layer, said metal and second layers having different affinities for a printing liquid selected from the group consisting of water and ink, said method comprising the steps of:

spacing a plasma-jet discharge source opposite and close to the printing surface; and without contacting said printing surface, exposing the metal layer to ionized plasma discharges from said plasma-jet discharge source at selected points thereon to remove said metal layer and expose said second layer at the selected points.

spacing a plasma-jet discharge source opposite and close to the printing surface; and without contacting said printing surface, exposing the first and second layers to ionized plasma discharges from said plasma-jet discharge source at selected points thereon to remove said first and second layers at the selected points, thereby exposing said third layer.

6. The method of claim 5 wherein the exposing step is accomplished by plasma discharge through a source that comprises a nozzle and an electrode inside the nozzle, the nozzle having an exit means that focuses the discharge on a precisely defined plate area.

7. The method of claim 6 wherein the plasma discharge is produced by applying a positive voltage to the electrode.

8. The method of claim 6 wherein the plasma discharge is produced by applying a negative voltage to the electrode.

9. The method of claim 5 and including the additional step of varying a characteristic selected from the group consisting of voltage, current and time duration of said plasma-jet discharges for varying the sizes of the spots produced by said discharges.

10. The method of claim 5 and including the additional steps of:

moving the discharge source and the plate relatively to effect a scan of the printing surface by the discharge source; and controlling the plasma discharges in accordance with picture signals representing an image so that they occur at selected times in the scan, thereby producing on the lithographic plate an array of image spots suitable for reproduction that corresponds to the picture represented by the picture signals.

11. A method of imaging a lithographic plate having a printing surface and including an oleophobic first layer, a metal second layer underlying said first layer, and an oleophilic third layer underlying said second layer, said method comprising the steps of:

spacing a plasma-jet discharge source opposite and close to the printing surface; and without contacting said printing surface, exposing the first and second layers to ionized plasma discharges from said plasma-jet discharge source at selected points thereon to remove said first and second layers at the selected points, thereby exposing said third layer.

12. The method of claim 11 wherein the exposing step is accomplished by plasma discharge through a source that comprises a nozzle and an electrode inside the nozzle, the nozzle having an exit means that focuses the discharge on a precisely defined plate area.

13. The method of claim 12 wherein the plasma discharge is produced by applying a positive voltage to the electrode.

14. The method of claim 12 wherein the plasma discharge is produced by applying a negative voltage to the electrode.

15. The method of claim 11 and including the additional step of varying a characteristic selected from the group consisting of voltage, current and time duration of said plasma-jet discharges for varying the sizes of the spots produced by said discharges.

16. The method of claim 11 and including the additional steps of:

moving the discharge source and the plate relatively to effect a scan of the printing surface by the electrode, and controlling the plasma discharges in accordance with picture signals representing an image so that they occur at selected times in the scan, thereby producing on the lithographic plate an array of image spots suitable for reproduction that corresponds to the picture represented by the picture signals.

* * * * *